United States Patent [19]

Derbyshire et al.

[11] 4,292,164

[45] Sep. 29, 1981

[54] LIQUEFACTION OF CARBONACEOUS MATERIAL WITH HYDROGEN AND NAPHTHA-EXTRACTED RECYCLE SOLVENT WITHOUT HETEROGENEOUS CATALYST

[75] Inventors: Francis J. Derbyshire, Lawrenceville; Darrell D. Whitehurst, Titusville, both of N.J.

[73] Assignee: Mobil Oil Corporation, New York, N.Y.

[21] Appl. No.: 107,817

[22] Filed: Dec. 28, 1979

[51] Int. Cl.[3] ..... C01G 1/00

[52] U.S. Cl. ..... 208/8 LE

[58] Field of Search ..... 28/8 LE

[56] References Cited

U.S. PATENT DOCUMENTS 3,018,241 1/1962 Gorin ..... 208/8 LE 3,583,900 6/1971 Gatsis ..... 208/8 LE 4,082,644 4/1978 Gatsis et al. ..... 208/8 LE

FOREIGN PATENT DOCUMENTS 2737337 8/1977 Fed. Rep. of Germany ... 208/8 LE

*Primary Examiner*—Delbert E. Gantz

*Assistant Examiner*—William G. Wright

*Attorney, Agent, or Firm*—C. A. Huggett; M. G. Gilman; E. J. Trojnar

[57] ABSTRACT

A process for the liquefaction of solid carbonaceous material, e.g., coal in the presence of hydrogen under pressure in the absence of heterogeneous hydrogenation catalyst using a hydrogen transfer solvent which is the fraction extracted from coal derived liquids by a process derived naphtha extractant containing less than 20 weight percent of aromatics. Coal derived liquids are extracted with naphtha and recycled as a slurry medium for the carbonaceous material.

12 Claims, No Drawings

LIQUEFACTION OF CARBONACEOUS MATERIAL WITH HYDROGEN AND NAPHTHA-EXTRACTED RECYCLE SOLVENT WITHOUT HETEROGENEOUS CATALYST

CROSS-REFERENCE TO RELATED APPLICATIONS

An application, Ser. No. 55,948 filed July 9, 1979 in the names of Francis J. Derbyshire, Thomas O. Mitchell and Darrell D. Whitehurst now abandoned, discloses a method for the liquefaction of solid carbonaceous materials, e.g., coal, with a hydrogen transfer solvent, such as pyrene, in the absence of heterogeneous hydrogenation catalyst.

BRIEF SUMMARY OF THE INVENTION

Solid carbonaceous material such as coal, is liquefied in a process which comprises the steps of (1) forming a slurry of the carbonaceous material in a hydrogen transfer solvent;

(2) heating the slurry in the presence of hydrogen in the substantial absence of heterogeneous hydrogenation catalyst at an elevated temperature and under pressure to achieve the desired conversion of the carbonaceous material to a liquid product;

(3) extracting the liquid product with naphtha containing less than 20% by weight of aromatics to obtain a hydrogen transfer solvent dissolved in naphtha;

(4) separating the hydrogen transfer solvent from the naphtha; and (5) recycling at least a portion of the naphtha-extracted hydrogen transfer solvent to step (1).

DETAILED DESCRIPTION OF THE INVENTION

The increasing scarcity of oil and gas, their continuously increasing price and the abundance of coal in the United States has made coal increasingly attractive as a substitute source of hydrogen fractions. In the past, coal has had limited use as a petroleum substitute because of the cost and complexity involved in its processing, its high heteroatom content, particularly sulphur, and because it is a solid. Processing has been utilized to reduce the sulphur content and to introduce hydrogen into the coal extract to enhance its heating value and reduce its sooty character when burned.

A common process for the liquefaction of coal is referred to as the Solvent Refined Coal process (SRC). In the SRC process finely comminuted coal is contacted with a hydrogen donor solvent at an elevated temperature, preferably in the presence of hydrogen, and optionally in the presence of a catalyst. Insoluble materials are removed from the product which is then separated into various fractions. Many factors affect the economics of the process. One factor is the efficiency of the introduction of hydrogen into the coal fractions compared to hydrogen usage for formation of water and light hydrocarbon gases. Another factor is the efficiency with which heteroatoms are removed, particularly sulphur and oxygen. A third factor is the nature and yield of the desired product. Still another factor is the degree of conversion of coal into usable products.

Because of the extremely large volume of material involved in coal processing small differences in efficiency or yield are of considerable significance. Thus, it is desirable that any new process give high conversions, that material be recyclable to the maximal extent and that the amount of extraneous material generated, such as spent catalyst be kept to the minimum.

A need for new methods for liquefying coal and other solid carbonaceous materials remains, particularly where the new method provides significant improvements considering one or more of the foregoing factors.

The term "solid carbonaceous material" as used herein includes any carbonaceous material containing less than about 96% carbon. Thus, the term includes materials such as anthracite coal, bituminous coal, subbituminous coal, lignite and peat. The terms includes carbonaceous materials which contain substantial amounts of organic oxygen, and pyritic and organic sulphur, but is not limited to such and includes, for example, materials having a low pyritic iron content.

A solid carbonaceous material which is subjected to the liquefaction process is in comminuted form. Ball mills or other kinds of conventional apparatus can be employed for comminution. Comminution can be accomplished in either a dry state or in the presence of a liquid such as the solvent used in the practice of the invention. The average particle size of the solid carbonaceous material is not highly critical and can be selected mainly for ease of handling and pumping. In general, the particle size is 100 mesh or smaller.

Process conditions can vary widely based on the nature of the carbonaceous material, solvent and other factors.

Generally, the process of this invention is conducted at a temperature in the range of 320° C. to 500° C. The temperature selected is sufficient to depolymerize the constituents in the solid carbonaceous material, but not so high as to be excessive. Temperatures in the range of 350° C. to 450° C. have been found to be particularly suitable.

The pressure utilized in the process can also be varied within wide limits sufficient to achieve the degree of conversion desired. For example, the pressure can range from 20 bar to 180 bar. More often, the pressure selected is in the range of 40 bar to 100 bar.

Residence time depends greatly on the components in the reaction, time and temperature. In general, the residence time ranges from 1 to 240 minutes. Preferably, conditions and components are selected so that the residence time is 3 to 60 minutes.

The process of this invention results in high conversions of the solid carbonaceous material to components which are solvent soluble. For example, conversions of at least about 60% are desired and conversions of 90% or more have been achieved. Conversion is measured by determining the percent of the product of the reaction which is soluble in quinoline. The method for determining conversion, denominated the "Quinoline Soxhlet Extraction" method, involves refluxing the product for approximately 17 hours (overnight) in a Soxhlet apparatus and determining the percent by weight of the product of reaction which has been extracted with quinoline.

The process of this invention can be conducted batch-wise, for example, in an autoclave or in a continuous manner. In either case, the essential aspect of the invention is that there is no heterogeneous hydrogenation catalyst added at any stage of the process. Nor is there any contact with heterogeneous hydrogenation catalyst such as in the EDS donor solvent process where a hydrogen donor solvent used in liquefaction is separated from the product and subjected to a step of hydrogenation in the presence of catalyst prior to being recycled to the liquefaction zone. It is the elimination of the heterogeneous catalyst which is an essential aspect of this invention. Elimination of the catalyst avoids the recognized disadvantages of catalysts used, such as deactivation of the catalyst by coke formation and the deposition of metals.

Another essential aspect of this invention is that it does not require solid carbonaceous materials containing large amounts of inorganic materials such as iron pyrite which is recognized as a hydrogenation catalyst. Indeed, the present invention is operative where the carbonaceous material contains less than one percent by weight of iron in the form of pyrite.

In order to achieve the efficiency possible with the present process, the constitution of the organic solvent which is used to slurry the coal is of the utmost importance. Suitable solvents are denominated hydrogen transfer solvents. The hydrogen transfer solvent described below is prepared by removal of light hydrocarbon components (boiling below 200° C.) followed by extraction of the liquid derived from coal liquefaction with a process derived naphtha having an aromatic content of 20 weight percent or less and a boiling range of 75° C. to 120° C. Preferably, the naphtha has an aromatic content of 10 weight percent or less. A naphtha obtained from crude untreated petroleum and boiling in the range of 100° C. to 140° C. and having an aromatic content of less than 10% has been found to be suitable. The fraction of coal liquid which is soluble in the naphtha is separated out for recycle as the hydrogen transfer solvent of this invention. In a preferred embodiment the naphtha extract is distilled to obtain for recycle that portion boiling above 230° C. or, more preferably, boiling above 300° C.

While we do not wish to be bound by a particular theory of our invention it appears that the hydrogen transfer solvents are capable of being thermally hydrogenated in the absence of hydrogenation catalysts under the temperature and pressure conditions useful in the present invention. It is also believed that the thermal hydrogenation products of the solvents which are selected have the ability of being dehydrogenated or donating hydrogen atoms to free radicals resulting from the depolymerization of constituents in the solid carbonaceous material. Thus, this process is believed to depend on the in situ hydrogenation and dehydrogenation of certain organic materials which are extracted with naphtha. Extraction with naphtha also reduces the proportion of polar constituents which are considered to be detrimental in the hydrogenation. At the same time the proportion of polynuclear aromatic components, which are considered to favor efficient hydrogenation, is increased.

The following Examples illustrate the present invention. Various modifications can be made in accordance with the foregoing disclosure.

EXAMPLE 1

This example illustrates the effect of aromatic content in naphtha or the solubility of coal derived liquids which are soluble in the naphtha.

Mixtures of toluene and a 100°-115° C. untreated midcontinent petroleum naphtha were used to extract (Soxhlet) a solvent refined coal (SRC-Wilsonville, Ala.) with the following results in Table 1.

TABLE 1

| | Raw Naphtha | | | |
|---|---|---|---|---|
| % Toluene | 9.8 | 30 | 50 | 75 |
| % SCR Extracted | 11 | 35 | 53 | 60 |

EXAMPLE 2

Following the procedure of Example 1 a mixture containing 80% toluene and 20% trimethylpentane extracted 52% of the same SRC.

EXAMPLE 3

A naphtha containing about 11% aromatics obtained from coking of an Athabaska tar sand followed by hydrotreating was used to isolate the non-polar products from a crude product stream of a coal liquefaction process development unit (Wilsonville, Ala.). The crude product contained both recycle solvent and coal liquids (about 2/1). To isolate the desired components for recycle or upgrading, the crude product mix was diluted 10/1 with naphtha. After standing for several hours, the insoluble material was recovered by filtration and washed with hexane. The yield of insoluble material was 32% of the total product mix. The soluble material was recovered by distillation and represented 68% of the total product. The whole naphtha free product, the 320° C. fraction and the 430° C. fraction are all superior solvents for coal liquefaction to the original mixture of recycle solvent and coal liquids from which they were derived.

EXAMPLES 4-6

Following the procedure of Example 3 the crude mix of that example was isolated using three additional naphtha as described below. In each case yields of about 66% of soluble products were obtained from the coal liquids.

| EXAMPLE | DESCRIPTION OF NAPHTHA |
|---|---|
| 4 | A naphtha obtained from crude untreated petroleum and distilled to a narrow range of 110°-115° C. This material is identical to that described in Example 1 and contains 9.8% aromatics. |
| 5 | A petroleum naphtha having a lower and broader boiling range. |
| | % Distilled — °C.: 20 — 75; 40 — 80; 60 — 110; EP — 115 |
| | This naphtha contains about 1.5% aromatics. |
| 6 | Mixed hexanes containing no aromatics or naphthenes. |

EXAMPLE 7

This example illustrates coal liquefaction in the presence of a naphtha-extracted coal liquid in accordance with this invention. The non-polar components of a 450°-850° C. boiling cut of a conventional coal liquefaction solvent are isolated by precipitation with the naphtha of Example 4. The yield of soluble and insoluble components are 80% and 20%, respectively. About 5 volumes of each of these fractions are admixed with 1 volume of Illinois #6 coal (Monterey mine) and the mix heated to 430° C. for 90 min in the presence of about 70 bar $H_2$. At the end of this period, the coal conversion is determined by extracting the whole product mix with pyridine. The coal conversions are about 90% with the non-polar (naphtha soluble) solvent and only about 60% with the polar (naphtha insoluble) solvent, demonstrating that the naphtha soluble components of the recycle solvent are superior to the naphtha insoluble components.

We claim:

1. A process for the liquefaction of solid carbonaceous material which comprises the steps of (1) forming a slurry of the solid carbonaceous material in a hydrogen transfer solvent;

(2) heating said slurry in the presence of hydrogen in the substantial absence of heterogeneous hydrogenation catalyst at a temperature and pressure sufficient to obtain a conversion of said solid carbonaceous material of at least 60% of a liquid product;

(3) extracting the liquid product boiling above 200° C. with process derived naphtha containing less than 20 percent by weight of aromatics;

(4) separating from the naphtha the components soluble therein as a recycle solvent; and (5) recycling at least a portion of said recycle solvent to step (1) as said hydrogen transfer solvent.

2. The process of claim 1 wherein heating is conducted at 320° C. to 500° C. under a pressure of 20 to 180 bar for 1 to 240 minutes.

3. The process of claim 1 wherein heating is conducted at 350° C. to 450° C., at a pressure of 40 to 100 bar for 3 to 30 minutes.

4. The process of claim 1 wherein the weight ratio of the hydrogen transfer solvent to carbonaceous material is from 1:1 to 5:1.

5. The process of claim 1 wherein the weight ratio of the hydrogen transfer solvent to carbonaceous material is 2:1 to 3:1.

6. The process of claim 1 wherein the carbonaceous material is coal.

7. The process of claim 1 wherein the carbonaceous material is peat.

8. The process of claim 1 wherein the carbonaceous material is lignite.

9. The process of claim 1 wherein said naphtha has a boiling point of 75° C. to 120° C.

10. The process of claim 1 wherein said naphtha contains less than 10 percent by weight of aromatics.

11. The process of claim 1 wherein said recycle solvent is that portion of the naphtha extract boiling above 230° C.

12. The process of claim 1 wherein said recycle solvent is that portion of the naphtha extract boiling above 300° C.

* * * * *